US007197854B2

(12) United States Patent
Bettigole et al.

(10) Patent No.: US 7,197,854 B2
(45) Date of Patent: Apr. 3, 2007

(54) PRESTRESSED OR POST-TENSION COMPOSITE STRUCTURAL SYSTEM

(75) Inventors: Robert A. Bettigole, Lakeville, CT (US); Christopher Higgins, Corvalis, OR (US)

(73) Assignee: D.S. Brown Co., North Baltimore, OH (US)

( * ) Notice: Subject to any disclaimer, the term of this patent is extended or adjusted under 35 U.S.C. 154(b) by 423 days.

(21) Appl. No.: 10/725,185

(22) Filed: Dec. 1, 2003

(65) Prior Publication Data

US 2005/0115195 A1 Jun. 2, 2005

(51) Int. Cl.
*E04B 1/18* (2006.01)

(52) U.S. Cl. ..... 52/414; 52/333; 52/334

(58) Field of Classification Search ..... 52/333, 52/335, 337, 223.6, 223.14, 231, 334, 327, 52/414, 319; 404/70, 134, 21; 14/74.5, 14/73, 74

See application file for complete search history.

(56) References Cited

U.S. PATENT DOCUMENTS 4,531,857 A 7/1985 Bettigole
4,531,859 A 7/1985 Bettigole
4,621,943 A * 11/1986 Swanson ..... 404/70
4,780,021 A 10/1988 Bettigole
4,865,486 A 9/1989 Bettigole
5,457,839 A * 10/1995 Csagoly ..... 14/73
5,509,243 A 4/1996 Bettigole et al.
5,664,378 A 9/1997 Bettigole et al.

OTHER PUBLICATIONS

Exo News, Exodermic Bridge Deck, Inc., Summer 2002, 12 pages.

* cited by examiner

*Primary Examiner*—Naoko Slack
*Assistant Examiner*—Jessica Laux
(74) *Attorney, Agent, or Firm*—Foley & Lardner LLP

(57) ABSTRACT

A prestressed or post-tensioned composite structural system for bridge floors, road beds, pedestrian walkways, building floors, building walls, or similar structural elements. The structural system comprises a composite structure comprising an unfilled grating as a base component, and a prestressed, post-tensioned reinforced concrete slab as a top component. The base grating component is preferably a plurality of main bearing bars without any distribution bars or tertiary bars. The upper portions of the main bearing bars are embedded in the concrete component permitting horizontal shear transfer and creating a composite deck structure which maximizes the use of tensile strength of steel and the compressive strength of concrete.

23 Claims, 6 Drawing Sheets

SECTION A-A

SECTION A-A

PRESTRESSED OR POST-TENSION COMPOSITE STRUCTURAL SYSTEM

CROSS-REFERENCE TO RELATED PATENT APPLICATIONS

None.

BACKGROUND OF THE INVENTION

The present invention relates to the improved construction of bridges, roads, sidewalks, and buildings. More particularly, the present invention relates to an improved unfilled grating composite with a reinforced, prestressed or post-tensioned concrete slab. The invention also relates to a method of making an improved unfilled grating composite with a reinforced, prestressed or post-tensioned concrete slab.

The widespread deterioration of road structures, specifically bridges, has been acknowledged as a critical problem in our Nation's transportation system. The Federal Government considers hundreds of thousands of bridges structurally deficient or functionally obsolete. A major factor contributing to such classifications is a deteriorated bridge deck (the roadway surface). The life span of the bridge deck averages only one half the service life of the other components of the average bridge.

The rehabilitation and re-decking of existing deficient structures, as well as deck designs for new structures, must account for many factors affecting bridge construction and rehabilitation. These factors include increased usage, increased loading, reduced maintenance, increased use of salts for snow and ice mitigation, and the need for lower costs, lighter weight, and more efficient construction techniques.

In the mid-1980's, the first patents issued on a new grid deck designed to solve the problems of prior designs. This new grid deck is referred to as an Exodermic™ deck. An Exodermic™ deck is comprised of a reinforced concrete slab on top of, and composite with, an unfilled steel grid. This maximizes the use of the compressive strength of concrete and the tensile strength of steel. Horizontal shear transfer is developed through the partial embedment in the concrete of the top portion of the main bars The following U.S. patents all relate to various features of an Exodermic™ deck: U.S. Pat. Nos. 4,531,857, 4,531,859, 4,780,021, 4,865,486, 5,509,243, and 5,664,378. These patents all disclose unfilled grid decks composite with reinforced concrete slabs.

Historically, the Exodermic™ deck evolved from traditional concrete filled grids. The innovation of these decks was to move the concrete from within the grid to the top of the grid in order to make more efficient use of the two components. Putting the concrete on top also allowed the use of reinforcing steel in the slab to significantly increase the negative moment capacity of the design, and moved the neutral axis of the section close to the fabrication welds of the grid. A shear connecting mechanism was required between the grid and the slab to make the two components into a composite structure. This was originally provided by using a grid having main bearing bars, distribution bars, and tertiary bars. Welded to the tertiary bars were short, ½" diameter studs which served to transfer shear and maintain a mechanical connection between components.

An Exodermic deck typically weighs 35% to 50% less than a reinforced concrete deck that would be specified for the same span. Reducing the dead load on a structure can often mean increasing the live load rating. The efficient use of materials in an Exodermic deck means the deck can be much lighter without sacrificing strength, stiffness, ride quality, or expected life.

In a revised design of an Exodermic deck, the tertiary bars were eliminated, which saved weight, cost, and fabrication problems. Thus, the grating included only main bearing bars and distribution bars. In this revised design, since there were no tertiary bars, the function of the shear transfer studs on the tertiary bars was taken over by extension of the main bars of the grid 1" into the slab. Holes were punched in the top 1" of the main bars, to aid in the engagement of the bars with the concrete.

In the revised design, the main bearing bars and the distribution bars are interconnected into a grating, which requires extensive fabrication. In order to assemble the grating, the main bearing bars have had fabrication holes punched into them. The distribution bars are inserted through the fabrication holes and welded to the main bearing bars at every intersection, to thereby form the grating structure.

Welding the main bearing bars and the distribution bars can induce distortion in the steel grating. Manufacturers may need to construct the steel gratings for unfilled grid decks composite with reinforced concrete slabs using purpose built jigs and a specialized welding pattern to minimize such distortion.

Because most unfilled grid decks composite with reinforced concrete slabs are constructed in environments where corrosion of the embedded and exposed steel is likely unless preventive measures are taken, the steel grating component is generally protected by hot-dip galvanizing. Warping of steel gratings due to hot-dip galvanizing is a substantial problem for all types of steel grating decks, including unfilled grid decks composite with reinforced concrete slabs. Warpage is due to a combination of stress relieving of the welds in the 850° F. molten zinc and by differential heating and cooling of the large grating panels as they are dipped in and then removed from the galvanizing kettles. This warping regularly produces grating panels that must either be reworked in the factory, or pushed and/or pulled into proper shape in the precast plant or in the field.

To eliminate some of these fabrication problems, U.S. Pat. No. 5,664,378 discloses a further variation of the Exodermic deck. This further revision eliminates not only the tertiary bars, but it also eliminates the distribution bars of the base grid component. Thus, this variation uses a base grating of only main bearing bars. It was thought that this would further reduce costs, weight, and fabrication issues. While it did achieve these objectives, it was found that eliminating the distribution bars created significant problems with shear transfer and durability.

The present invention has eliminated or minimized the problems that result when the distribution bars are eliminated. The present invention has found that using prestressed or post-tensioned concrete allows the distribution bars of the grid to be eliminated, yet still maintain effective shear transfer and durability in a grating that is made from only main bearing bars.

SUMMARY OF THE INVENTION

This invention provides a new unfilled grating composite with reinforced concrete slab design. The present invention uses a grating of only main bearing bars. The grating does not use distribution bars or tertiary bars. However, the present invention still provides for improved shear connection between the grating component and the reinforced concrete slab. By eliminating the need for distribution bars, the invention eliminates some of the punching and all of the welding required to fabricate a grid.

In place of the distribution or tertiary bars, the invention uses prestressed or post-tensioned concrete, with the main bearing bars extending into the concrete component. The prestressed or post-tensioned concrete provides for an improved shear connection between the grating and concrete which allows the distribution bars to be eliminated. The improved shear connection provides improved composite interaction between the grating and the concrete component, simplifies construction of an improved unfilled grating composite with reinforced concrete slab, reduces the amount of steel used in the steel component, and reduces the cost of an improved unfilled grating composite with reinforced concrete slab.

By prestressing or post-tensioning the concrete component of the design, the present invention also replaces an important function of the distribution bars, which can thereby be eliminated while still permitting the deck to provide the span capacities and strength and fatigue resistant properties of unfilled grid decks composite with reinforced concrete slabs with distribution bars.

In the current invention, prestressing or post-tensioning of the concrete component preferably in the direction normal to the main bearing bars of the grating provides improved composite interaction by providing the constraint necessary to insure that the concrete component does not split, and the concrete around the shear connectors acts in direct shear, significantly increasing its shear capacity.

Prestressing or post-tensioning the concrete component can insure that the concrete is partially or fully in compression under service loads in the direction normal to the main bearing bars, allowing the uncracked concrete to participate fully in stiffening and strengthening the section. Greater stiffness in the direction normal to the main bearing bars yields better moment distribution, mobilizing more main bearing bars, and reducing the moment the deck has to handle from service loads in the direction of the main bearing bars.

Thus, an effective unfilled grating composite with reinforced concrete slab may be made according to the present invention with only a concrete component and main bearing bars. The compression-inducing elements, such as prestressing strand or post-tensioning tendons are preferably located at mid-height of the concrete component to provide balanced force on the concrete component's cross section, preventing undesired cambering of the deck panels.

The present invention replaces the function of distribution bars with prestressing or post-tensioning. Without distribution bars, all welding is eliminated, removing one source of warpage during hot-dip galvanizing. Main bearing bars are galvanized as individual bars, further reducing the likelihood of warpage. Many more main bearing bars can be galvanized in a single dip, significantly reducing the cost of galvanizing.

Without distribution bars, the main bearing bars are held in their desired position during manufacture by the use of jigs or temporary or permanent spacing devices. The concrete component holds the main bearing bars in position after it has cured.

Although it is preferred to form the shear connectors as a portion of the main bearing bars, alternatively, the shear connector portion can be formed as a separate component welded to the main bearing bars.

Preferably, steel reinforcing bars, or rebars, are used to reinforce the concrete, as is conventional.

Compression-inducing elements, such as prestressing strands or post-tensioning tendons (in ducts), are used preferably to induce compression in the direction normal to the main bearing bars. The compression-inducing elements, and/or rebar, may be placed in the holes and recesses formed in the upper portion of the main bearing bars.

The present invention provides a light weight, low cost, easily fabricated unfilled grating composite with reinforced concrete slab having an improved shear transfer structure. The shear connecting structure is embedded within the top component and is capable of resisting shear forces in three axes, including a first horizontal axis transverse to said main bearing bars, a second horizontal axis parallel to said main bearing bars, and a third vertical axis perpendicular to the top surface of the main bearing bars. The shear connectors thus effect shear transfer in the longitudinal direction, i.e., parallel to the bar having the shear connecting structure; provide a mechanical lock and effect shear transfer in the lateral direction, i.e., perpendicular to the bar having the shear connecting structure; and prevent vertical separation between the top component and the grating base member. Proper functioning of the shear connection mechanism is assured by prestressing or post-tensioning the concrete in the direction normal to the main bearing bars.

These and other benefits and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENTS

Figure 1:
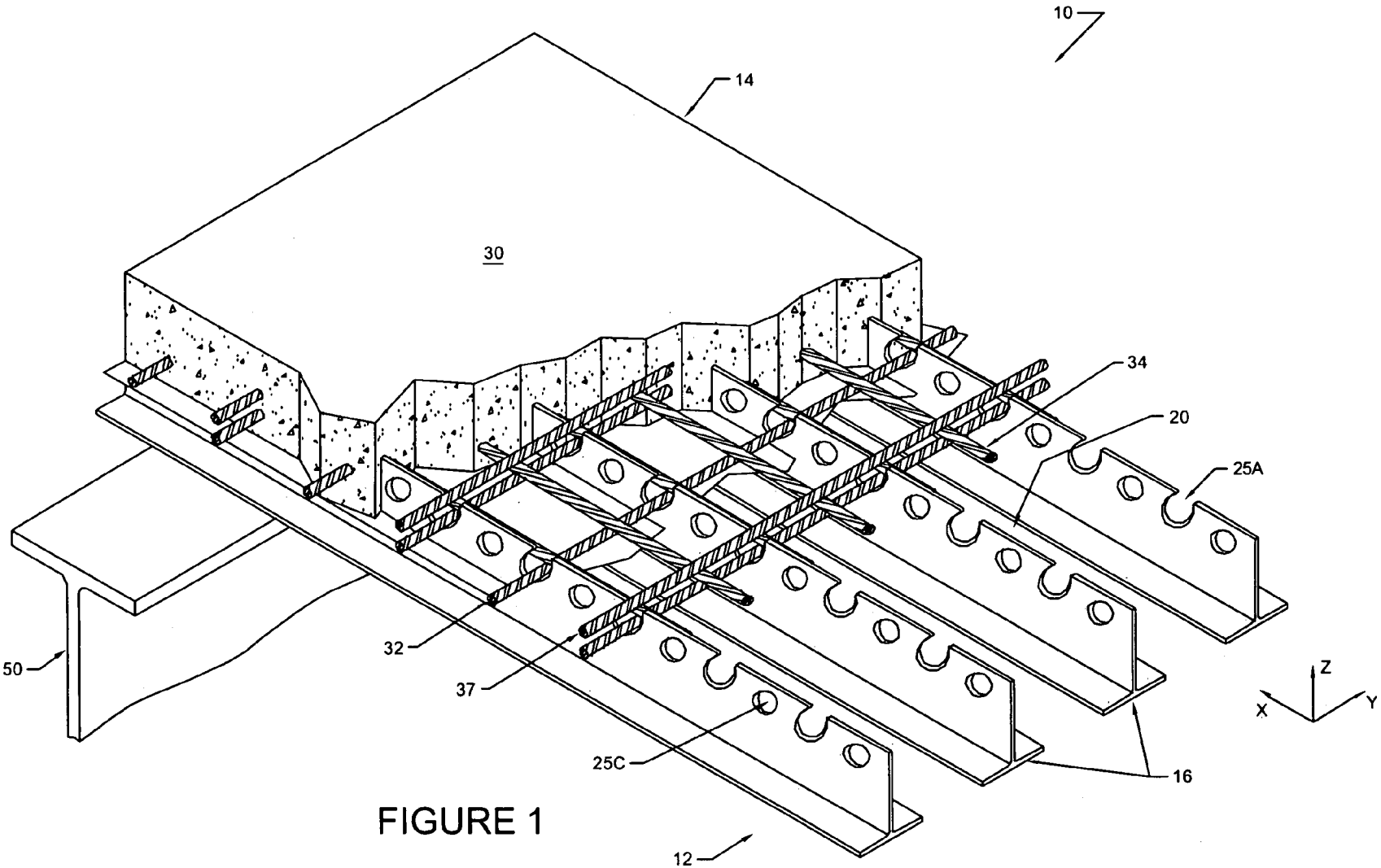
FIG. 1 is an isometric view of an unfilled grating composite with reinforced concrete slab.

An unfilled grating composite with reinforced concrete slab is generally indicated at 10. Unfilled grating composite with reinforced concrete slab 10 is preferably intended to contact, be supported on, and transmit forces to support members 50 either directly or through a concrete haunch to form a structural floor which can be a bridge floor, a road bed, a pedestrian walkway, a support floor for a building, or the like. Unfilled grid decks composite with reinforced concrete slabs can also be used as structural or decorative walls, where support member 50 would be a column. Unfilled grating composite with reinforced concrete slab 10 will typically be formed off-site in modular units and transported to the field and installed, though it is also possible to form them in place.

In its preferred form, unfilled grating composite with reinforced concrete slab 10 is a composite structure comprised of an open-lattice grating base member or grating component 12, preferably made of steel, and a top component 14, preferably made of reinforced concrete. As described in more detail below, a portion of grating component 12 is embedded in top component 14 to advantageously transfer horizontal shear forces between reinforced concrete component 14 and grating component 12 and to maximize the benefits of the excellent compressive strength of concrete and the excellent tensile strength of steel.

As shown in FIG. 1, grating component 12 includes a plurality of substantially parallel main bearing bars 16 (shown as extending in the X-direction). Grating component 12 does not include tertiary bars or distribution bars.

Figure 2:
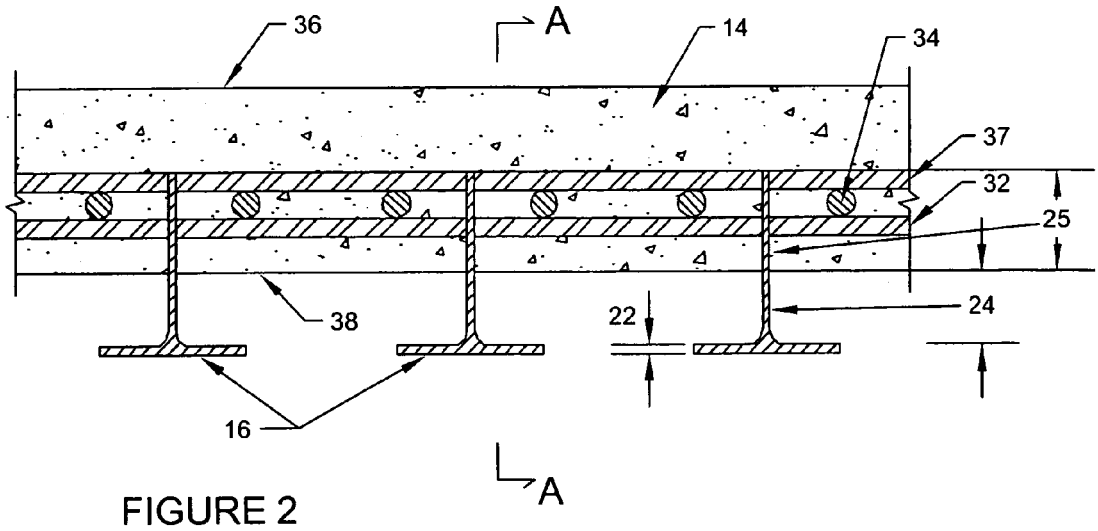
FIG. 2 is a cross-section of the deck shown in FIG. 1 having prestressing strands.

As best shown in FIG. 2, main bearing bars 16 are generally and most efficiently T-shaped and include a lower horizontal section 22, a substantially planar intermediate vertical section 24, and a top section 25.

Figure 3:
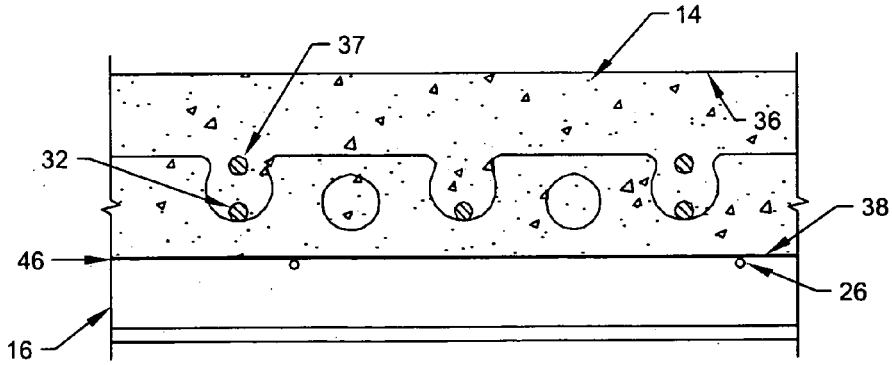
FIG. 3 is a cross-section of the deck shown in FIG. 1, oriented at 90 degrees from the cross-section shown in FIG. 2.
Figure 2A:
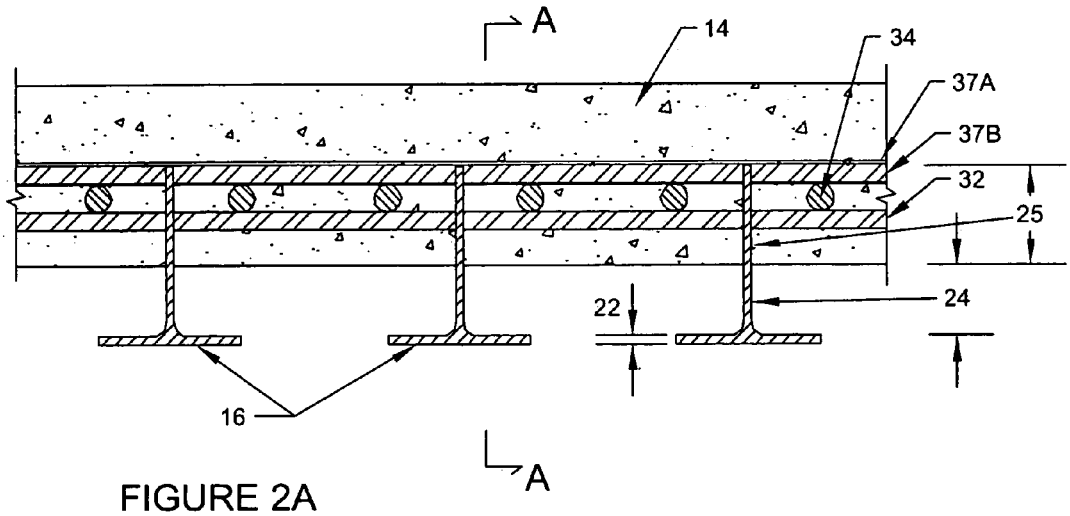
FIG. 2A is a cross-section of the deck shown in FIG. 1 having post-tensioning tendons
Figure 3A:
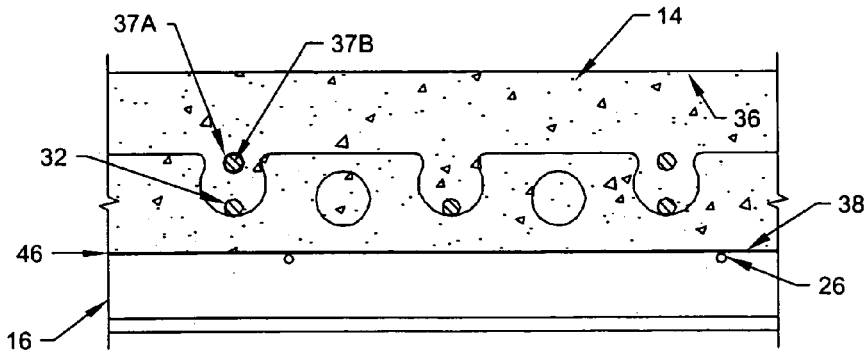
FIG. 3A is a cross-section of the deck shown in FIG. 1, oriented at 90 degrees from the cross-section shown in FIG. 2A.

As best shown in FIG. 3, assembly apertures or fabrication holes 26 may be provided in intermediate vertical sections 24 of main bearing bars 16 to allow the insertion of rods or other members to support permanent or temporary formwork 46 for the reinforced concrete component.

Top component 14 preferably consists of a material capable of being poured and setting, e.g., concrete 30. In the preferred design, concrete 30 is reinforced by a plurality of reinforcing bars, such as shown at 32, and a plurality of reinforcing bars, such as shown at 34. Typically, the reinforcing bars 32, 34 are oriented at right angles to each other, with one of the bars parallel to main bearing bars 16.

Prestressing and post-tensioning of concrete is a common technique in the manufacture and installation of precast concrete structural elements for bridges and buildings. Because concrete is relatively weak in tension, it is prone to cracking, even when reinforcing steel is present to provide adequate strength. Prestressing or post-tensioning of concrete puts concrete into compression before the element is put into service carrying load. Under load, the precompression of the concrete counteracts tensile forces that may be induced, preventing cracking. Prestressing of concrete is accomplished by tensioning high strength steel prestressing strand before concrete is placed into the formwork. The prestressing strand is located at or close to the neutral axis of the concrete in order to prevent distortion of the finished precast element. Once the concrete has cured, the ends of the prestressing strand are cut, and the resulting contraction of the strand puts the concrete, to which it is now bonded, into compression.

An alternate way to achieve the same result of compression within the concrete top element is to cast hollow tubes, generally known as ducts, into the precast concrete element (at or near the neutral axis location). Once the concrete has cured, high strength rods, also known as tendons, are inserted in the ducts, and tensioned, such as by using jacks or other commonly used contruction techniques. Anchors are attached to the end of the tendons to lock in the tensile force, and the jacks are then released. As with prestressing, post-tensioning of a concrete element will act to keep it from cracking under load.

Prestressing strand 37, or post-tensioning ducts 37A and tendons 37B, are generally located normal to the main bearing bars 16, but may be skewed in the construction of skewed unfilled grating composite with reinforced concrete slab panels. With sufficient prestressing strand 37, or post-tensioning ducts 37A and tendons 37B, reinforcing bars 32 may be eliminated. Prestressing strand 37, or post-tensioning ducts 37A and tendons 37B may be placed in the recesses 25A or 25B or through the holes 25C in the main bearing bars 16.

Reinforcing bars and prestressing strand or post-tensioning tendons may be protected from corrosion by epoxy coating or other means. Main bearing bars 16, and reinforcing bars 32 and 34 are preferably formed of steel, and epoxy coated or galvanized to inhibit corrosion. Alternatives include fiber reinforced plastics, solid stainless steel, or carbon steel with stainless steel cladding. Uncoated steel may be used in applications where corrosion is not a concern. In lieu of reinforcing bars 32, 34, a reinforcing mesh may be used to reinforce concrete 30. Where an ultra high performance material with adequate tensile strength is substituted for standard concrete, reinforcing bars 32, 34 may not be required.

Reinforced concrete component 14 includes a planar top surface 36 providing a road surface, either directly or with a separate wear surface, and a planar bottom surface 38 located below the top surface of main bearing bars 16, and encompassing the embedded upper portions 25 of main bearing bars 16.

Embedded upper portions 25 permit mechanical locks to be formed between reinforced concrete component 14 and grating component 12 in the vertical direction (Z-axis), and in a horizontal plane in the longitudinal (X-axis) and lateral (Y-axis) directions. The mechanical locks: (i) assure longitudinal and lateral horizontal shear transfer from reinforced concrete component 14 to grating component 12, (ii) prevent separation between reinforced concrete component 14 and grating component 12 in the vertical direction, and (iii) provide structural continuity with reinforced concrete component 14, permitting reinforced concrete component 14 and grating component 12 to function in a composite fashion. While a small chemical bond may be formed due to the existence of adhesives in the concrete, without a mechanical lock in the longitudinal direction (X-axis), the longitudinal shear transfer is insufficient to permit reinforced concrete component 14 and grating component 12 to function in a totally composite fashion.

In order to provide the mechanical lock between the grating and the top component, top section 25 of main bearing bar 16 is shaped in the longitudinal direction (X-axis) to provide gripping surfaces. These may be in any shape to provide a connection suitable for the load to be carried. This may be simply deforming the top section 25, using cutouts, or some other form of connection.

Figure 4:
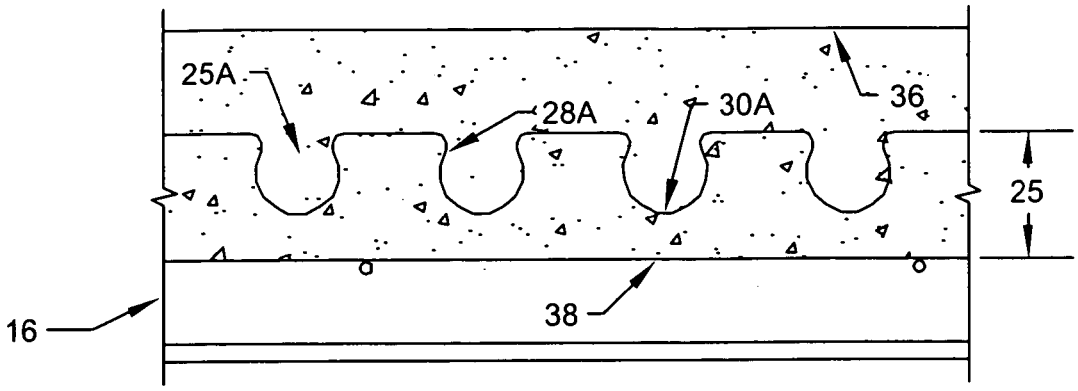
FIG. 4 shows one embodiment of a main bearing bar where shear transfer is effected with the use of "C" shaped recesses.
Figure 5:
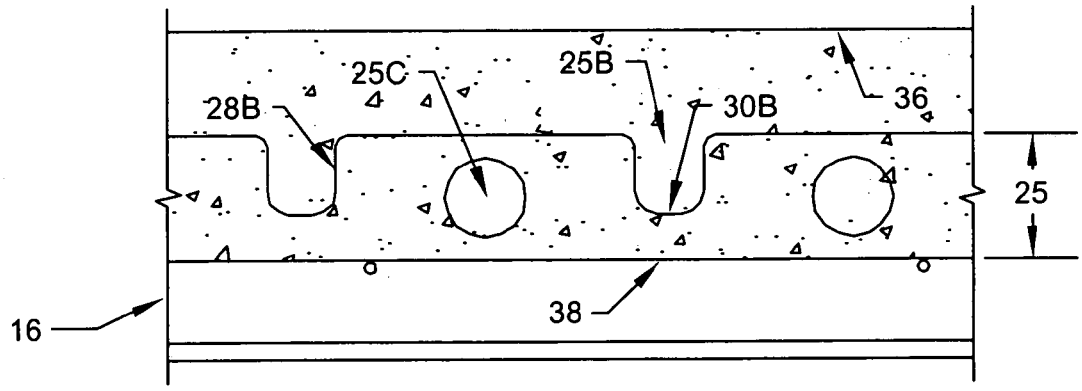
FIG. 5 shows one embodiment of a main bearing bar where shear transfer is effected with the use of "U" shaped recesses and round holes.
Figure 6:
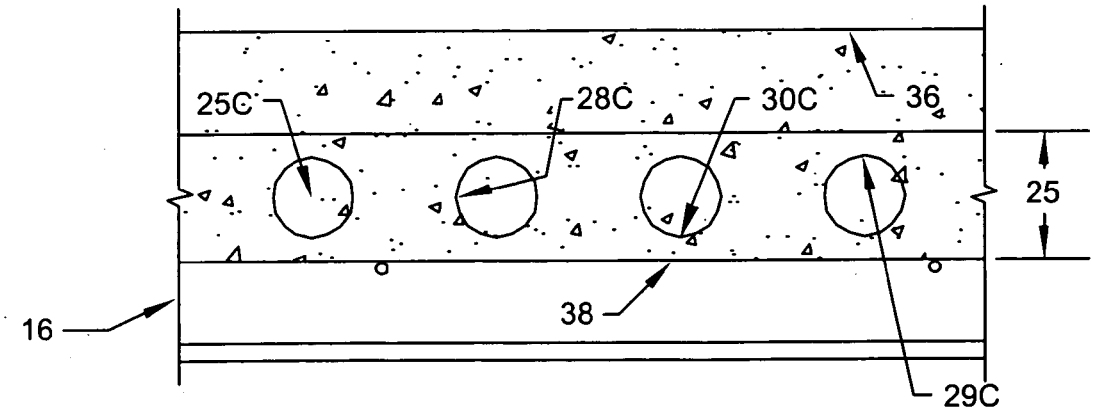
FIG. 6 shows one embodiment of a main bearing bar where shear transfer is effected with the use of round holes.

In one form of the invention, shown in FIG. 4, the top portion 25 of the main bearing bar is shaped with a plurality of "C" shaped recesses 25A. The recesses have inwardly inclined side surfaces 28A, and a bottom surface 30A. In another form of the invention, shown in FIG. 5, the top portion 25 of the main bearing bar is shaped with a plurality of "U" shaped recesses 25B. The recesses have parallel side surfaces 28B, and a bottom surface 30B. In this form of the invention, a plurality of holes, 25C may be used to provide mechanical lock in the vertical direction. In a third form of the invention, shown in FIG. 6, a plurality of holes 25C, which may be round or otherwise, are formed (by drilling, punching, or other means) in the top portion 25 of the main bearing bar. The holes 25C have a side surface 28C and a bottom surface 30C.

In the embodiments described above, in the Y-direction normal to the main bearing bar, the upper portion of the main bearing bar 25 without recesses resists shear. In the X-direction parallel to the main bearing bar, the concrete component fills the "C" shaped recess 25A, the "U" shaped recess 25B, or the holes 25C. Horizontal shear resistance is provided by the edge or side wall 28A, 28B, or 28C and by the strength of concrete component 30 that fills the recesses and/or holes. In the Z-direction, the relatively small vertical separation forces are resisted by the upper, overhanging portion of inclined side surfaces 28A, the bond with the side surfaces of 28B, or the top portion of the holes 29C.

In an alternative embodiment, a combination of recesses 25A and/or 25B and holes 25C may be used.

To maximize deck strength and minimize deck weight, it is desirable that planar bottom surface 38 be located only as required to adequately embed the shear connecting mechanisms 25A, 25B, and/or 25C. Concrete 30 does not fill the interstices 20 of grating component 12. This feature can be achieved by a number of different methods.

Figure 7:
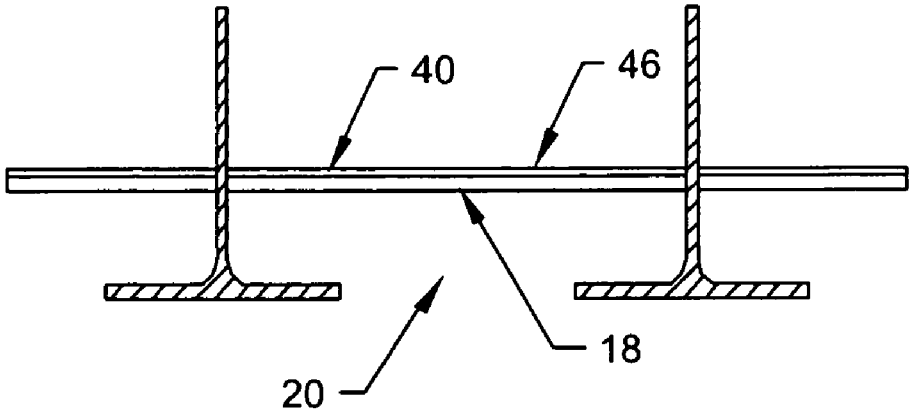
FIG. 7 shows a temporary support and temporary form pan used in the forming of the concrete component of the invention.
Figure 8:
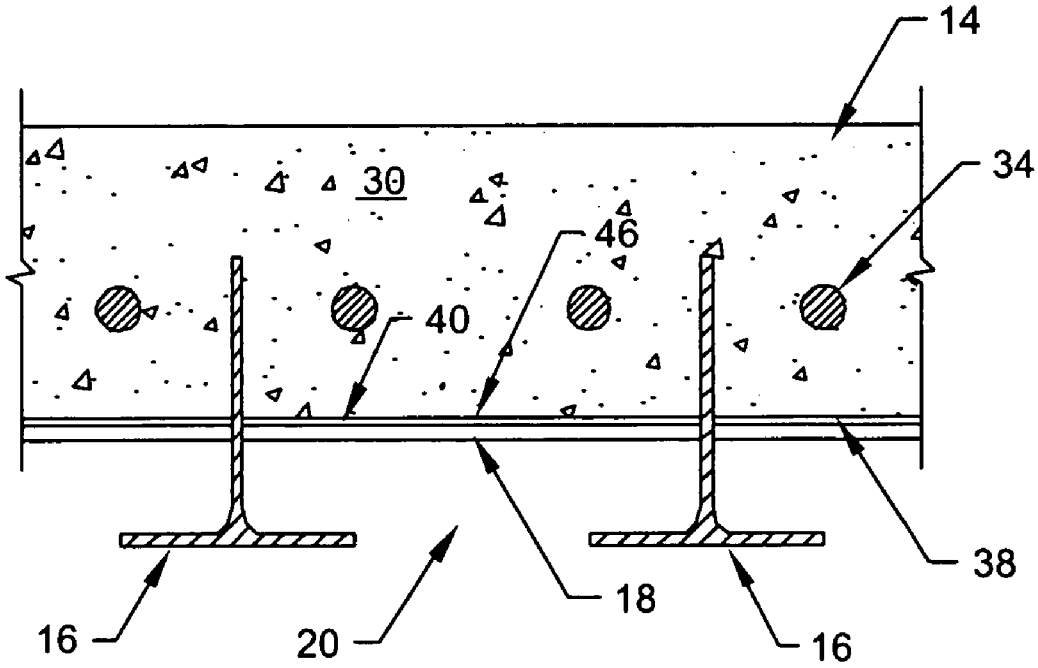
FIG. 8 shows the temporary support and temporary form pan illustrated in FIG. 7, after the concrete component of the invention has been cast.

In a preferred arrangement, intermediate barriers 46, e.g., strips of sheet metal, can be placed onto top surfaces 40 of temporary supports 18 between adjacent main bearing bars 16, as shown in FIG. 7 and FIG. 8. When concrete 30 or another material is subsequently poured onto grating component 12, intermediate barriers 46 create a barrier, preventing concrete 30 from traveling therethrough and filling interstices 20. Concrete 30 remains on intermediate barriers 46 creating planar bottom surface 38 of reinforced concrete component 14. However, in lieu of sheet metal strips, expanded metal laths, plastic sheets, fiberglass sheets, or other material can be used to create planar bottom surface 38. Additionally, biodegradable sheets, e.g., paper sheets or corrugated cardboard, could also be used, as the primary purpose of intermediate barriers 46 is preventing concrete 30 from filling the interstices 20 of grating component 12, and this purpose is fully achieved once concrete 30 is cured. Once concrete has cured, temporary supports 18 can be removed, and intermediate barriers 46 can be removed or left in place.

Alternatively, planar bottom surface 38 of reinforced concrete component 14 can be formed by placing a lower barrier, e.g., a form board, underneath main bearing bars 16 and filling interstices 20 to the desired level with a temporary filler material, e.g., sand, plastic foam or other similar material. Concrete 30 may then be poured onto the temporary filler material and the temporary filler material will prevent concrete 30 from filling the interstices 20. Once the concrete 30 is cured, the lower barrier and temporary filler material can be removed and the deck may be transported to site for installation. This technique is explained in U.S. Pat. Nos. 4,780,021 and 4,865,486 which are hereby incorporated by reference herein.

In the alternative, deck 10 can be formed by placing grating component 12 upside-down on top of reinforced concrete component 14, which would be inside a forming fixture, and to gently vibrate both components. Reinforced concrete component 14 then cures to grating component 12 but does not penetrate and fill interstices 20 of grating component 12. One well-known method of vibrating the components is to use a shake table, but other vibrating devices and techniques may also be used.

Figure 9:
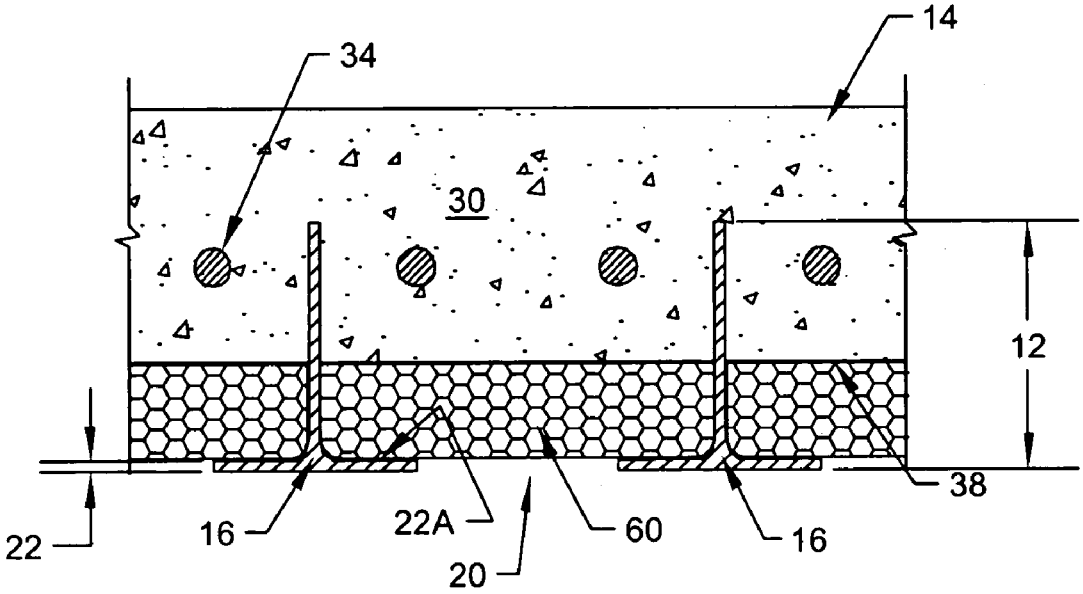
FIG. 9 shows temporary forms still in place after the concrete component of the invention has been cast.

Alternatively, as shown in FIG. 9, planar bottom surface 38 of reinforced concrete component 14 can be formed by placing temporary form blocks 60, e.g., blocks of wood, between the main bearing bars 16 and supported by the tops 22A of the bottom flanges 22 of the main bearing bars or by alternative temporary supports. When concrete 30 or another material is subsequently poured onto grating component 12, temporary form blocks 60 create a barrier, preventing concrete 30 from traveling therethrough and filling interstices 20. Concrete 30 remains on temporary form blocks 60 creating planar bottom surface 38 of reinforced concrete component 14. However, in lieu of blocks of wood, blocks of foam, plastic, fiberglass, or other material can be used to create planar bottom surface 38. Once concrete 30 has cured, temporary form blocks 60 can be removed.

Compression-inducing elements, such as prestressing strands 37, or post-tensioning rods or tendons 37B, consisting of steel, carbon fiber, or other material, are placed preferably transverse to main bars 16 within the reinforced concrete component 14. However, the compression-inducing elements may be placed at an angle to the main bearing bars to facilitate construction. Even when placed at an angle, the compression induced should be in the direction normal to the main bearing bars. Compression-inducing elements such as rods 37 induce precompression into reinforced concrete component 14 before external loads are applied to deck 10. The magnitude of precompression in reinforced concrete component 14 provided by the compression-inducing elements can be controlled to achieve desirable stress levels in reinforced concrete component 14. The preferred embodiment would employ high-strength steel strands 37 to prestress reinforced concrete component 14 or high-strength steel tendons 37B to post-tension reinforced concrete component 14 to a level that would limit transverse concrete stresses below the concrete flexural cracking stress when deck 10 is subject to external loads. This would maintain the stiffness of deck 10 in the transverse direction, eliminate requirements for distribution bars and associated welding, and provide additional confining of concrete 30 within the shear connecting mechanisms 25A, 25B, and/or 25C of the main bearing bars 16 to aid composite action between reinforced concrete component 14 and main bearing bars 16. Partial-prestressing/post-tensioning may be used to obtain other stress levels in reinforced concrete component 14 to achieve desired performance and economy of deck 10. Coatings and other treatments for the prestressing/post-tensioning elements may be employed to enhance their corrosion resistance. Other materials may be used as prestressing/post-tensioning elements that provide higher strength, higher ductility, reduced weight, lower relaxation, reduced anchorage slip, improved corrosion resistance, lower costs, or other advantages.

Unfilled grating composite with reinforced concrete slab 10 is particularly advantageous because it possesses the same or similar strength and fatigue life characteristics as existing unfilled grid decks composite with reinforced concrete slabs having the same section modulus per unit of width. However, deck 10 can be produced at a substantially lower cost, and with comparable weight. In unfilled grating composite with reinforced concrete slab 10, prestressing strand or post-tensioning ducts and tendons would be used to provide adequate resistance to bending moments in the direction normal to the main bearing bars 16. Sufficient prestressing or post-tensioning would be applied to reduce or eliminate cracking of the concrete in the direction normal to the main bearing bars 16, thereby extending the life of the unfilled grating composite with reinforced concrete slab 10. With sufficient prestressing or post-tensioning, all of the concrete in the direction normal to the main bearing bars could be maintained in compression under service loads, allowing all of the concrete to be effective in resisting bending moments in the Y direction. And, as unfilled grating composite with reinforced concrete slab deck 10 does not include distribution bars, the product cost of the distribution bars and the assembly costs of welding the distribution bars to the main bearing bars at each intersection is eliminated, and overall product cost is reduced. In addition, grating warpage due to hot-dip galvanizing is substantially reduced, further reducing costs, and providing additional time savings in erection due to better deck panel tolerances.

Efficacy and durability of the structural system is greatly increased by prestressing or post-tensioning the reinforced concrete component. Prestressing or post-tensioning also maximizes the contribution of the concrete component to the strength and stiffness of the composite system in the direction normal to the grating component, and has the additional benefit of enabling better load distribution across multiple elements of the grating component.

In a preferred embodiment, reinforced concrete component 14 is 5 inch thick. Main bearing bars 16 are inverted WT5×6 structural T's, with the top portions 25 thereof being shaped to provide gripping surfaces. Main bearing bars 16 weigh approximately 6-lbs/linear foot and are spaced apart on 8-inch centers. The main bearing bears extend about 1 inch into the concrete component. Reinforcing bars 34 are preferably #6 rebar spaced apart on 4-inch centers. Reinforcing bars 32 are preferably #4 rebar spaced apart on 6-inch centers. Prestressing strand 37 is preferably one half inch diameter, 270,000 pound per square inch high tensile strength, low relaxation, prestressing strand, stressed to 200,000 pounds per square inch when the concrete is placed. In addition, the intermediate barriers 46 are 20-gauge galvanized sheet metal strips. However, it is recognized that one skilled in the art could vary these parameters to meet the design requirements associated with specific sites.

The concrete 30 used may be any standard structural concrete. One preferred concrete is a high performance concrete because it serves as an additional barrier to prevent chlorides and moisture from reaching steel grating component 12 and causing premature deterioration. A preferred coarse aggregate is ¾-inch crushed stone. A typical high performance concrete substitutes microsilica and fly ash for a portion of the Portland cement, and water to cement ratios are limited to 0.40 to decrease deck permeability and increase strength. A latex modified concrete, as is well known in the industry, could also be used as the top layer. Reinforced concrete component 14 may further include an asphaltic concrete or similar material wear surface (not shown) applied on top of component 14. Other concrete formulations providing adequate compressive strength may also be used. Ultra high performance materials may also be used and, with sufficient tensile strength, may reduce or eliminate the need for reinforcing steel.

Main bearing bars 16 are preferably hot rolled steel and may be either galvanized, coated with an epoxy, or otherwise protected from future deterioration. In addition, or as an alternative, stainless steel, or a weathering steel, such as ASTM A709 Grade 50 W, may be used.

Specific characteristics of unfilled grid decks composite with reinforced concrete slabs and details for manufacturing unfilled grid decks composite with reinforced concrete slabs are disclosed in the commonly assigned prior U.S. Pat. Nos. 4,531,857, 4,531,859, 4,780,021, 4,865,486, 5,509,243, and 5,664,378 which are hereby incorporated by reference.

If desired, shear members, such as vertically oriented studs or dowels, angles or channels, may be attached to or integrally formed with the upper portions 25 of main bearing bars 16 to provide additional structure to be embedded into reinforced concrete component 14. The vertically oriented studs or dowels, angles or channels enhance the horizontal shear transfer from reinforced concrete component 14 to grating component 12.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention. For example, while the preferred materials used for grating component 12 and top component 14 are steel and concrete, respectively, fiber-reinforced plastic and an epoxy-aggregate, e.g., epoxy-concrete, could also respectively be used. In addition, grating component 12 and top component 14 could be made from other materials recognized by one of ordinary skill.

What is claimed is:

1. A structural element comprising:

a grating base member formed solely by a plurality of main bearing bars and without distribution or tertiary bars, said main bearing bars spaced to define interstices therebetween, said main bearing bars having an upper portion and a bottom portion;

a top component fixed to said grating base member, said top component being in compression in the direction normal to the main bearing bars, said top component having a planar top surface and a planar bottom surface, said planar bottom surface of said top component being substantially above the bottom portion of said main bearing bar so that said top component does not fill the interstices of said grating base member; and at least one compression-inducing element within said top component for creating said compression;

said upper portions of said plurality of main bearing bars defining a shear transfer element, and said shear transfer element embedded within said top component.

2. The structural element as recited in claim 1, wherein said top component compression is provided by prestressing.

3. The structural element as recited in claim 1 wherein said top component compression is provided by post-tensioning.

4. A structural element comprising:

a grating base member formed solely by a plurality of main bearing bars and without distribution or tertiary bars, said main bearing bars spaced to define interstices therebetween, said main bearing bars having an upper portion and a bottom portion;

a top component fixed to said grating base member, said top component in compression under service loads in the direction normal to the main bearing bars, said top component having a planar top surface and a planar bottom surface, said planar bottom surface of said top component being substantially above the bottom portion of said main bearing bar so that said top component does not fill the interstices of said grating base member;

said upper portions of said plurality of main bearing bars defining a shear transfer element, said shear transfer element embedded within said top component;

compression-inducing elements within said top component for creating said compression within said top component, said compression-inducing elements placed within the top component so as to induce compression in a direction normal to the main bearing bars.

5. The structural element as recited in claim 4, wherein said compression-inducing elements are placed within the top component transverse to the main bearing bars.

6. A structural element comprising:

a grating base member formed solely by a plurality of main bearing bars and without distribution or tertiary bars, said main bearing bars spaced to define interstices therebetween, said main bearing bars having an upper portion and a bottom portion;

a top component fixed to said grating base member, said top component in compression in the direction normal to the main bearing bars, said top component having a planar top surface and a planar bottom surface, said planar bottom surface of said top component being substantially above the bottom portion of said main bearing bar so that said top component does not fill the interstices of said grating base member;

said upper portions of said plurality of main bearing bars defining a shear transfer element, and said shear transfer element embedded within said top component;

wherein said top component compression is provided by prestressing; and wherein prestressing strands are placed within the top component transverse to the main bearing bars.

7. The structural element as recited in claim 6, wherein the upper portion of one or more of said main bearing bars comprise a plurality of spaced holes formed in said main bearing bar for providing an enhanced connection between the grating component and the top component.

8. The structural element as recited in claim 6, wherein the upper portion of one or more of said main bearing bars comprise a plurality of spaced "C" shaped recesses formed in said main bearing bar for providing an enhanced connection between the grating component and the top component.

9. The structural element as recited in claim 8, wherein at least one of said prestressing strands is positioned within at least one of said recesses formed in said main bearing bars.

10. The structural element as recited in claim 9, wherein said top component includes reinforcing bars.

11. The structural element as recited in claim 6, wherein the upper portion of one or more of said main bearing bars comprise a plurality of spaced "U" shaped recesses formed in said main bearing bar for providing an enhanced connection between the grating component and the top component.

12. The structural element as recited in claim 11, wherein at least one of said prestressing strands is positioned within at least one of said recesses formed in said main bearing bars.

13. A structural element comprising:

a grating base member formed solely by a plurality of main bearing bars and without distribution or tertiary bars, said main bearing bars spaced to define interstices therebetween, said main bearing bars having an upper portion and a bottom portion;

a top component fixed to said grating base member, said top component in compression in the direction normal to the main bearing bars, said top component having a planar top surface and a planar bottom surface, said planar bottom surface of said top component being substantially above the bottom portion of said main bearing bar so that said top component does not fill the interstices of said grating base member;

said upper portions of said plurality of main bearing bars defining a shear transfer element, and said shear transfer element embedded within said top component;

wherein said top component compression is provided by post-tensioning; and wherein post-tensioning tendons are placed within the top component transverse to the main bearing bars.

14. The structural element as recited in claim 13, wherein the upper portion of one or more of said main bearing bars comprise a plurality of spaced holes formed in said main bearing bar for providing an enhanced connection between the grating component and the top component.

15. The structural element as recited in claim 13, wherein the upper portion of one or more of said main bearing bars comprise a plurality of spaced "C" shaped recesses formed in said main bearing bar for providing an enhanced connection between the grating component and the top component.

16. The structural element as recited in claim 15, wherein at least one of said post-tensioning tendons is positioned within at least one of said recesses formed in said main bearing bars.

17. The structural element as recited in claim 16, wherein said top component includes reinforcing bars.

18. The structural element as recited in claim 13, wherein the upper portion of one or more of said main bearing bars comprise a plurality of spaced "U" shaped recesses formed in said main bearing bar for providing an enhanced connection between the grating component and the top component.

19. The structural element as recited in claim 18, wherein at least one of said post-tensioning tendons is positioned within at least one of said recesses formed in said main bearing bars.

20. A method of making a structural element comprising the steps of:

forming a grating base member from a plurality of main bearing members without distribution or tertiary bars;

spacing said main bearing bars to define interstices therebetween, connecting a top component to said grating base member so that said top component does not fill the interstices of said grating base member, said step of connecting the top component to the grating base member further comprising the step of embedding upper portions of the main bearing bars within the top component for transferring shear and for preventing vertical separation between the top component and said grating base member; and creating compression with compression-inducing elements within said top component in the direction normal to the main bearing bars whereby said compression is maintained under service loads.

21. The method of claim 20 wherein the step of creating compression comprises prestressing the top component.

22. The method of claim 20 wherein the step of creating compression comprises post-tensioning the top component.

23. The method of claim 22 wherein the step of post-tensioning further comprises the steps of:

casting hollow tubes into the top component near the neutral axis location;

inserting high strength rods through the ducts; and creating a tensile force within the rods to place the rods under tension.

* * * * *